United States Patent [19]

Anzalone

[11] 4,373,353

[45] Feb. 15, 1983

[54] REFRIGERANT CONTROL

[75] Inventor: Carmen J. Anzalone, Old Bridge, N.J.

[73] Assignee: Fedders Corporation, Edison, N.J.

[21] Appl. No.: 825,218

[22] Filed: Aug. 17, 1977

[51] Int. Cl.[3] ..... F25B 5/00; F25B 41/04

[52] U.S. Cl. ..... 62/200; 62/199; 62/217; 62/504

[58] Field of Search ..... 62/199, 200, 504, 525, 62/217

[56] References Cited

U.S. PATENT DOCUMENTS

| | | | |
|---|---|---|---|
| 1,960,663 | 2/1935 | Muffly | 62/217 X |
| 2,128,020 | 8/1938 | Smilack | 62/199 |
| 2,267,152 | 12/1941 | Gygax | 62/504 |
| 2,282,385 | 5/1942 | Shawhan | 62/217 X |
| 2,402,802 | 6/1946 | Carter | 62/504 X |
| 2,432,859 | 12/1947 | Carter | 62/504 X |
| 2,655,794 | 10/1953 | Ruff | 62/504 X |
| 2,707,868 | 5/1955 | Goodman | 62/504 X |
| 2,916,894 | 12/1959 | McGrath | 62/217 X |
| 2,961,844 | 11/1960 | McGrath | 62/199 X |
| 3,003,332 | 10/1961 | Watkins | 62/217 X |
| 3,108,453 | 10/1963 | Tinkey | 62/200 |
| 3,120,743 | 2/1964 | Wilson | 62/504 |
| 3,390,540 | 7/1968 | Brush | 62/200 |
| 3,434,299 | 3/1969 | Nussbaum | 62/199 |
| 3,677,028 | 7/1972 | Raymond | 62/200 |
| 3,722,230 | 3/1973 | Scott et al. | 62/217 X |
| 3,786,648 | 1/1974 | Rice | 62/200 |
| 3,866,439 | 2/1975 | Bussjager et al. | 62/504 |
| 3,977,205 | 8/1976 | Dreisziger et al. | 62/504 X |

FOREIGN PATENT DOCUMENTS

| | | | |
|---|---|---|---|
| 1025695 | 4/1953 | France | 62/199 |
| 4540395 | 12/1970 | Japan | 62/199 |

*Primary Examiner*—Leslie A. Braun

*Attorney, Agent, or Firm*—McAulay, Fields, Fisher, Goldstein & Nissen

[57] ABSTRACT

A refrigerant control, for a room air conditioner, operates to reduce the load on the compressor by throttling the flow of refrigerant to a predetermined number of circuits in the condensor, while allowing the flow of refrigerant to the remaining circuits to be unaffected.

6 Claims, 2 Drawing Figures

REFRIGERANT CONTROL

BACKGROUND OF THE INVENTION

The operation of a room air conditioner in areas where the outside temperature is high, can result in discharge pressures for the compressor which become elevated to a level whereby the compressor becomes overloaded and fails to operate properly. Normally, under such conditions, an automatic overload switch will deenergize the compressor to prevent it from becoming damaged due to overloading. This, of course, will result in a complete loss in cooling capacity of the air conditioner.

In order to maintain some cooling capacity under such conditions, some large compressor units have been fitted with a control device which, in effect, reduces the capacity of the compressor to reduce the load on the compressor. Practical considerations preclude the use of such devices on the smaller compressors found in "room-type" air conditioners.

Another method, which has been employed to maintain some cooling capacity under heavy loads while reducing the danger of damage to the compressor, or its "shut-down" as a result of overloading, is the use of an automatic expansion valve to throttle the refrigerant flow to all of the evaporator coil circuits. This device, in response to increasing pressure in the system, reduces the flow of refrigerant to the evaporator coil circuits and thereby effectively reduces the load on the compressor.

There is a loss in the efficiency of the air conditioner unit inherent in both of the above systems, but some cooling capacity is maintained.

SUMMARY OF THE INVENTION

A refrigerant control system according to the present invention is intended especially for use in small air conditioning units such as room type units. It operates primarily to reduce the load on the compressor by reducing the capacity of the evaporator of a room air conditioner and is an improvement over the second system discussed above for small compressors, especially in that it accomplishes a similar result while maintaining more efficient operation of the evaporator and thereby more efficient energy use by the air conditioner under load conditions.

In general, the control system utilizes an evaporator which has a plurality of evaporator coil circuits, each independent of the others with respect to flow therethrough and each independently fed by a separate expansion device. An important feature of the present invention is the direct control of refrigerant flow through a predetermined number of the evaporator coil circuits in response to the changes in pressure differential across the compressor. More specifically, a refrigerant control system according to the present invention employs expansion devices being operable to control the flow of refrigerant therethrough in inverse relationship to the pressure differential across the devices, at least over a range readily determinable by persons of ordinary skill in the art from the present disclosure, in place of predetermined number of expansion devices feeding evaporator coil circuits. Suitable expansion devices are well known in the art and are known as automatic expansion valves. These valves act to throttle refrigerant flow therethrough in response to an increased pressure differential thereacross, at least over their range of control. The remaining evaporator coil circuits are supplied by expansion devices, such as usually employed capillaries, which are without the inverse pressure flow control construction. In fact, the flow across these devices normally increases with an increase in pressure differential, as is well known.

In operation, when the pressure across the compressor rises above a predetermined level, which pressure differential is applied across the automatic expansion valves or other similar devices through the various elements of the unit, the flow to only a predetermined number of evaporator coil circuits, which circuits are supplied by the automatic expansion valves, is throttled by the valves. The flow to the remaining circuits is unaltered except, of course, that there will be a greater supply of refrigerant liquid available to these circuits as a result of the throttled flow to others of the circuits. Thus, under a wide range of operating conditions, there will be sufficient refrigerant flow to properly flood at least some of the evaporator coil circuits. As is well known in flooded type evaporator coil circuits, such evaporator coil circuits operate at their highest efficiency when they are properly flooded.

This system unexpectedly has greater efficiency for the operation of the air conditioner unit than was previously attained by means which, as described above, merely reduced the evaporator capacity by throttling the refrigerant flow to all of the evaporator circuits. The increased system efficiency results from increased efficiency in operation of the evaporator when several of the circuits are operating at full capacity and the remaining circuits are throttled, when compared with the operation of the evaporator when all of the circuits are throttled by an equivalent amount, coupled with the practical considerations of construction, compressor motor capacity and compressor operation.

BRIEF DESCRIPTION OF THE DRAWINGS

For a fuller understanding of the nature and objects of the invention, reference should be had to the following detailed description, taken in connection with FIG. 1 in which a schematic of an air conditioning system, including a refrigerant control system according to the present invention, is illustrated.

DESCRIPTION OF THE PREFERRED EMBODIMENT

Figure 1:
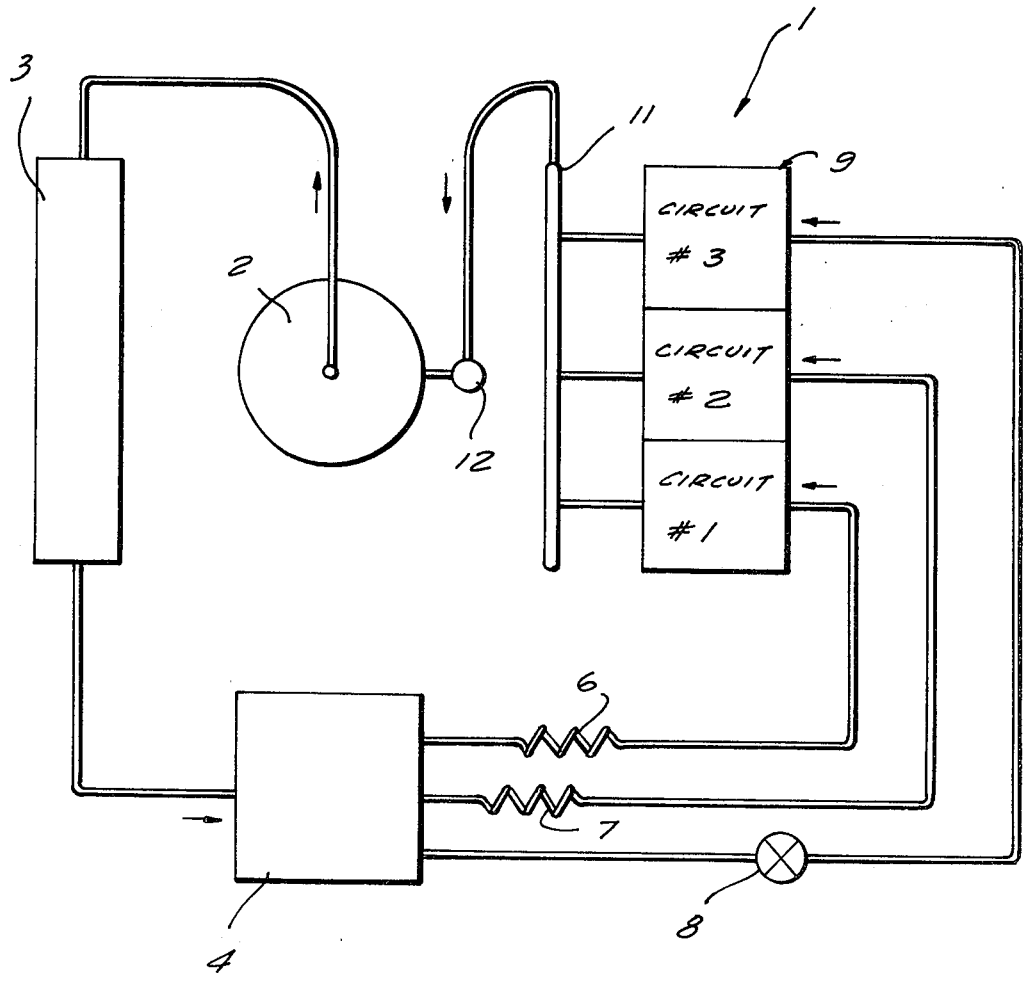

With reference FIG. 1, an air conditioner 1 includes a motor driven compressor 2; a condensor 3; a distributor 4; expansion devices such as capillaries 6, 7; an automatic expansion valve or similar inverse pressure flow device 8; an evaporator 9 having a plurality of circuits; a manifold 11; and an accumulator 12. These various elements are operably interconnected by refrigerant fluid conduits, as shown. The arrows indicate the direction of refrigerant fluid flow through the system.

In operation, the compressor 2 compresses refrigerant fluid which flows to the condensor 3, where gaseous refrigerant fluid gives up heat and condenses to a liquid. The liquid refrigerant fluid flows to the distributor 4 which distributes it to the various expansion devices 6, 7, 8. Each expansion device 6, 7, 8 is connected to a corresponding independent circuit in the evaporator 9. The refrigerant liquid absorbs heat at the evaporator 9 and is thereby vaporized. The vapor passes into manifold 11 and into the accumulator 12 from which it is drawn into the compressor 2, to begin the cycle again. The nature of these elements is well-known or would be obvious from the context of this disclosure.

When the condensor 3, normally disposed in heat exchange relationship with the outside air, is exposed to high ambient temperatures, as is well known the pressure in the condensor 3 can become high enough for the compressor 2 to be unable to properly function. The pressure at the output of the compressor 2 can easily become high enough to stall the compressor 2 operation. Normally the compressor 2 is fitted with an overload protection device (not shown) which will turn it off before it is damaged. The present invention reduces the overload "turn-off time" for the compressor 2 by reducing the load on the compressor 2.

The evaporator 9, as illustrated in the drawing, has three independent circuits. As will be obvious from the following discussion, any number of circuits (more than one) can be used. Each circuit is fed by a separate expansion device 6, 7, 8. Some of the expansion devices 6, 7, are of "fixed construction," that is, they incorporate no fluid flow throttling means. At least one evaporator circuit as discussed above, is fed through an automatic expansion valve 8 or similar device which will control the refrigerant flow therethrough in inverse relation to the pressure differential thereacross at least at pressures near a predetermined pressure, in an endeavor to maintain the predetermined pressure. During an overload situation caused by high condensor 3 pressure, valve 8 will throttle the flow of fluid in an endeavor to maintain a constant pressure. Normal flow will be reestablished when the pressure reduces.

As can be seen from FIG. 1, the automatic expansion valve 8 is, in fact, influenced by the pressure in all of the circuits and across the compressor 2 because of the common distributor 4 feeding all circuits and the common single manifold returning the fluid to the compressor 2 through accumulator 12.

By throttling the fluid flow only in a predetermined number of the circuits in the evaporator 9, the remaining circuits will receive substantially a full flow of refrigerant liquid over a wide range of conditions. As is well known, flooded coil type evaporator circuits operate most efficiently when they are fully flooded because they generally operate at lower coil temperatures than do partial partially flooded evaporator circuits. Thus, the circuits receiving an unthrottled flow will operate substantially at full efficiency while, with the previous method which utilized only one automatic expansion valve located where the distributor 4 is shown in the drawing and which required only a single evaporator circuit, partial flooding and associated reduced efficiency in evaporator operation resulted. The result of operating two of three circuits at full efficiency by proper flooding has been found to provide greater cooling capacity than will result from three circuits operating at an operating efficiency corresponding to a two-thirds partially flooded condition. Theoretically, less efficient evaporator operation should require less energy than more efficient evaporator operation because less refrigerant is used and therefore the load is further reduced on the compressor. However, it has been found in practice, as was noted above, that because the compressor and motor capacities are fixed and there is a certain amount of energy necessary to operate the compressor irrespective of the load thereon, practical design considerations result in a higher cooling efficiency with respect to energy consumed when the present invention is employed.

Figure 2:
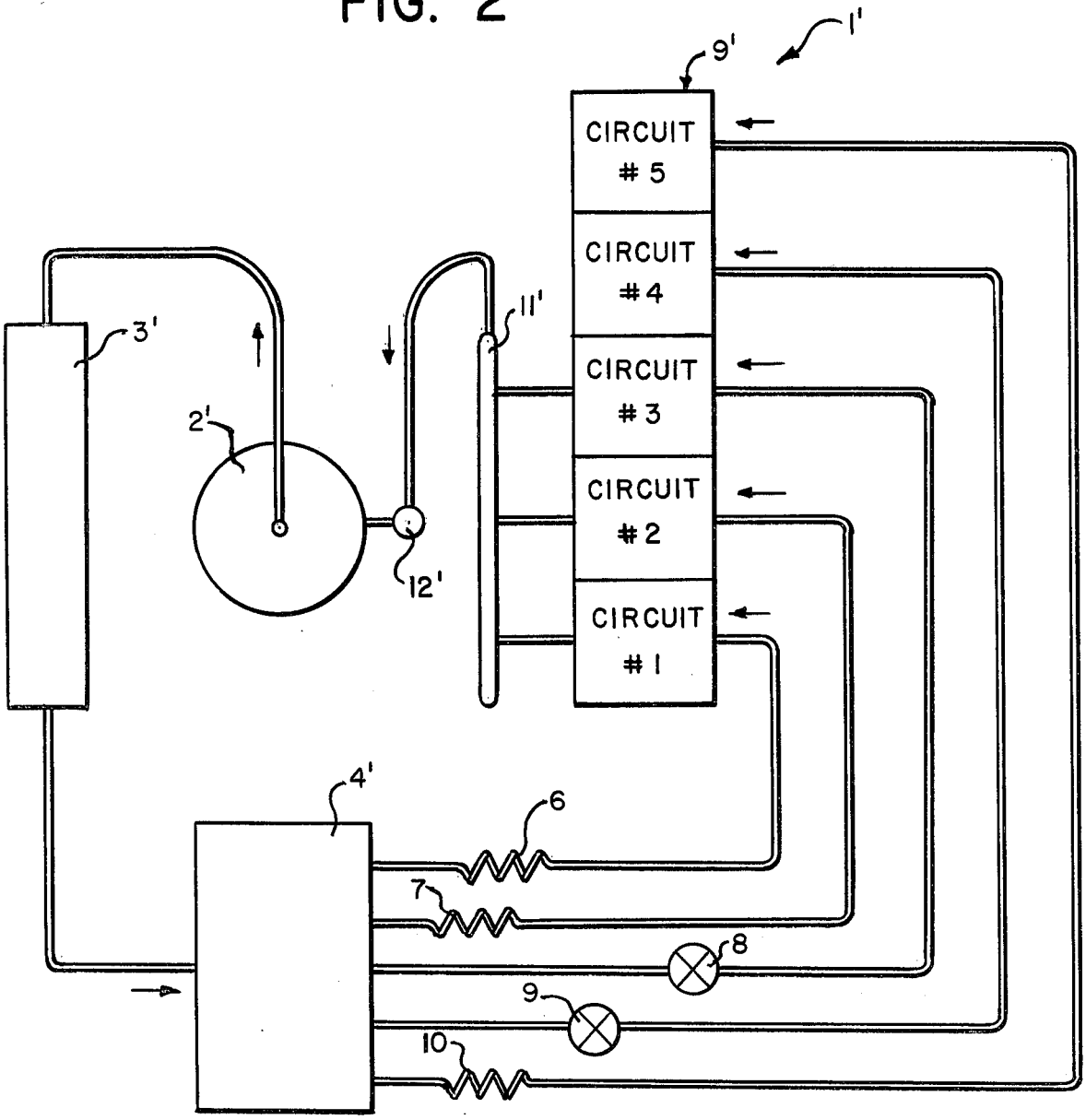
FIG. 2 in which a modified schematic of an air conditioning system, including a refrigerant control system according to the present invention, is illustrated.

While FIG. 1 illustrates an air conditioning system employing three independent circuits, an air conditioning system with additional independent circuits, in accordance with the present invention, is illustrated in FIG. 2. Common parts, except for the expansion devices are indicated in FIG. 2 with the same number as in FIG. 1, with a prime. The separate expansion devices illustrated on the independent circuits of FIG. 2 includes the "fixed construction" or capillary devices 6, 7, and 10 for circuits 1, 2, and 5, as well as automatic expansion valves 8 and 9 which control circuits 3 and 4. Operation of the device of FIG. 2 is as generally described, previously, for FIG. 1.

While specific embodiments have been shown and described, it is not intended that the invention be limited to these embodiments as obvious modifications will occur to a person skilled in the art.

What is claimed is:

1. A refrigerant control system in combination with an air conditioner having a compressor with a high pressure output and a suction input, a condensor, and an evaporator, the control system being operable to reduce the capacity of the evaporator in response to a heavy load on the system, thereby to reduce the load on the compressor, the improvement comprising:

(a) said evaporator including:

a first evaporator coil circuit, and a second evaporator coil circuit, said first circuit and said second circuit being independent of each other; and (b) said control system including:

a distributor receiving liquid refrigerant from said condensor, a first feed conduit having only one fluid control first means associated therewith which first control means consists of a first expansion device for the liquid refrigerant, operably connecting said first circuit to said distributor, said first expansion device being operable to impart to said first conduit a direct pressure-fluid flow characteristic whereby an increase in the pressure differential across said first conduit will normally result in an increase in fluid flow through said first conduit, a second feed conduit operably connecting said second circuit to said distributor and having only one fluid flow control second means associated therewith which second control means consists of a second expansion device for the liquid refrigerant, said second expansion device being operable to impart to said second conduit an inverse pressure-fluid flow characteristic which, over a predetermined operating range, will result in a decrease in or substantially complete throttling of, any fluid flow through said second circuit with an increase in the pressure differential across said second conduit, thereby to make the system responsive to a heavy load by reducing the capacity of the evaporator, while sustaining a flow of liquid refrigerant through said first circuit.

2. A combination as claimed in claim 1 wherein said second expansion device comprises an automatic expansion valve.

3. A combination as claimed in claim 2 wherein said first expansion device comprises a capillary.

4. A combination as claimed in claim 1 wherein:

said evaporator further includes a third evaporator coil circuit independent of the other evaporator coil circuits, and said control system further including a third feed conduit operably connecting said third circuit to said distributor and including a third expansion device being operable to impart to said third conduit a direct pressure-fluid flow characteristic whereby an increase in the pressure differential across said third conduit will normally result in an increase in fluid flow through said third circuit.

5. A combination as claimed in claim 4 wherein:

said evaporator further includes a fourth evaporator coil circuit independent of the other evaporator coil circuits, and said control system further includes a fourth feed conduit operably connecting said fourth circuit to said distributor and including a fourth expansion device for the liquid refrigerant, said fourth expansion device being operable to impart to said fourth conduit an inverse pressure-fluid flow characteristic which, over a predetermined operating range, will result in a decrease in fluid flow through said fourth circuit with an increase in the pressure differential across said fourth conduit.

6. A combination as claimed in claim 4 wherein:

said evaporator further includes an additional evaporator coil circuit independent of the other evaporator coil circuits, and said control system further including an additional feed conduit operably connecting said additional circuit to said distributor and including an additional expansion device being operable to impart to said additional conduit a direct pressure-fluid flow characteristic whereby an increase in the pressure differential across said additional conduit will normally result in an increase in fluid flow through said additional circuit.

* * * * *